US007649450B2

(12) United States Patent
Campion, Jr. et al.

(10) Patent No.: US 7,649,450 B2
(45) Date of Patent: Jan. 19, 2010

(54) METHOD AND APPARATUS FOR AUTHENTICATED ON-SITE TESTING, INSPECTION, SERVICING AND CONTROL OF LIFE-SAFETY EQUIPMENT AND REPORTING OF SAME USING A REMOTE ACCESSORY

(76) Inventors: Christopher M. Campion, Jr., 1935 Cottage Pl., West Belmar, NJ (US) 07719-3317; Harold H. Woodbury, III, 14227 Canteen Ct., Centreville, VA (US) 20121

( * ) Notice: Subject to any disclaimer, the term of this patent is extended or adjusted under 35 U.S.C. 154(b) by 351 days.

(21) Appl. No.: 11/699,458

(22) Filed: Jan. 30, 2007

(65) Prior Publication Data

US 2008/0084291 A1 Apr. 10, 2008

Related U.S. Application Data

(60) Provisional application No. 60/849,478, filed on Oct. 5, 2006.

(51) Int. Cl.
*G08B 29/00* (2006.01)

(52) U.S. Cl. ..... 340/514; 340/506

(58) Field of Classification Search ..... 340/514, 340/506, 516, 539.16
See application file for complete search history.

(56) References Cited

U.S. PATENT DOCUMENTS 4,725,818 A 2/1988 Motyka et al.
6,678,355 B2 * 1/2004 Eringis et al. ..... 379/22
6,737,967 B2 5/2004 Farley
6,950,016 B2 9/2005 Farley
6,960,987 B2 11/2005 Dohi et al.
7,167,088 B2 * 1/2007 Farley ..... 340/514
7,227,450 B2 * 6/2007 Garvy et al. ..... 340/506
7,301,455 B2 * 11/2007 McKenna et al. ..... 340/506

OTHER PUBLICATIONS

"Installation and Programming Manual: AFP-300/400 Intelligent Fire Detection and Alarm System." *Notifier Inertia Fire Systems*. Software Version 2.2. Revision AUS 3 (2000):pp. 1-40.

"Fire Alarm Control Panel: MS-9200UD/ MS-9200UDE." *Fire-Lite Alarms*. Document No. 51906. Revision A (Dec. 10, 2002): pp. 1-111.

(Continued)

*Primary Examiner*—John A Tweel, Jr.
(74) *Attorney, Agent, or Firm*—Posz Law Group, PLC

(57) ABSTRACT

A method, apparatus, remote accessory and authentication server are provided for facilitating operations such as an authenticated test of life safety equipment having components including a control panel and sensors. The life safety equipment requires testing according to a fire code. An access procedure is conducted to identify equipment and testing requirements and to establish a communication session between the equipment and an authentication server during an authenticated test. Another access procedure is conducted to provide access for a remote device for facilitating the authenticated test and to establish a communication session between the remote device and an alarm system or authentication server, or the like. Information associated with an impending activation of one of the sensors is received from the remote device and information associated with the sensor, when activated, is reported if detected by the alarm system, to the authentication server and the reported activation information is forwarded to the remote device. Authentication information associated with the activated sensor whether or not detected is received from the remote device and an authenticated report is forwarded to the remote device when all of the alarm condition sensors are tested according to test procedures.

20 Claims, 14 Drawing Sheets

OTHER PUBLICATIONS

"Technical Fax: Hyperterminal Configuration." *EST Technical Services*. TSFORM.011. Revision 1.0 (Aug. 2000): pp. 1-3.

"New Addressable Devices & Detector Sensitivity Supplement." *Fire-Lite Alarms*. Document No. 51526. Revision A (Feb. 14, 2001): pp. 1-2.

"Guide to Systems of Operation." *Campion Enterprise*. pp. 1-15.

"Uniform Fire Code: State of New Jersey." May 2004: pp. 1-309. *Spring Lake Fire Department*. Mar. 26, 2007. <http://www.springlakefd.org/UFC/NJ%20Uniform%20Fire%20Code.pdf>.

"Chapter 5: Fire Protection Systems." *New Jersey State Fire Prevention Code*. (1996): pp. 19-25.

* cited by examiner

1101

INSPECTION AND TESTING FORM

DATE: November 1st, 2006

TIME: 15:32 hrs

SERVICE ORGANIZATION

Name: Any Alarm Company

Address: 1234 ABC Lane, Somewhere, NJ

Representative: Bill Smith

License No.: NJ DFS Permit #P1234567

Telephone: (201) 123-4567

PROPERTY NAME (USER)

Name: Management Company

Address: 5678 EFG Road, Somewhere, NJ

Owner Contact: Ron Doe

Telephone: 201-456-7890

MONITORING ENTITY

Contact: A UL Central Station

Telephone: 1-800-123-4567

Monitoring Account Ref. No.: 1234UL

APPROVING AGENCY

Contact: _____

Telephone: _____

TYPE TRANSMISSION

- ☐ McCulloh
- ☐ Multiplex
- ☒ Digital
- ☐ Reverse Priority
- ☐ RF
- ☐ Other (Specify) _____

SERVICE

- ☐ Weekly
- ☐ Monthly
- ☐ Quarterly
- ☐ Semiannually
- ☒ Annually
- ☐ Other (Specify) _____

Control Unit Manufacturer: Notifier

Model No.: AFP-200

Circuit Styles: _____

Number of Circuits: _____

Software Rev.: _____

Last Date System Had Any Service Performed: _____

Last Date that Any Software or Configuration Was Revised: _____

ALARM-INITIATING DEVICES AND CIRCUIT INFORMATION

| Quantity | Circuit Style | |
|---|---|---|
| | | Manual Fire Alarm Boxes |
| | | Ion Detectors |
| | | Photo Detectors |
| | | Duct Detectors |
| | | Heat Detectors |
| | | Waterflow Switches |
| | | Supervisory Switches |
| | | Other (Specify): _____ |

(NFPA Inspection and Testing 1 of 4)

FIG. 11A

1102

ALARM NOTIFICATION APPLIANCES AND CIRCUIT INFORMATION

| Quantity | Circuit Style | |
|---|---|---|
| _____ | _____ | Bells |
| _____ | _____ | Horns |
| _____ | _____ | Chimes |
| _____ | _____ | Strobes |
| _____ | _____ | Speakers |
| _____ | _____ | Other (Specify): _____ |

No. of alarm notification appliance circuits: _____

Are circuits monitored for integrity? ☐ Yes ☐ No

SUPERVISORY SIGNAL-INITIATING DEVICES AND CIRCUIT INFORMATION

| Quantity | Circuit Style | |
|---|---|---|
| _____ | _____ | Building Temp. |
| _____ | _____ | Site Water Temp. |
| _____ | _____ | Site Water Level |
| _____ | _____ | Fire Pump Power |
| _____ | _____ | Fire Pump Running |
| _____ | _____ | Fire Pump Auto Position |
| _____ | _____ | Fire Pump or Pump Controller Trouble |
| _____ | _____ | Fire Pump Running |
| _____ | _____ | Generator In Auto Position |
| _____ | _____ | Generator or Controller Trouble |
| _____ | _____ | Switch Transfer |
| _____ | _____ | Generator Engine Running |
| _____ | _____ | Other: _____ |

SIGNALING LINE CIRCUITS

Quantity and style (See NFPA 72, Table 3-6) of signaling line circuits connected to system:

Quantity _____ Style(s) _____

SYSTEM POWER SUPPLIES a. Primary (Main): Nominal Voltage _____, Amps _____

Overcurrent Protection: Type _____, Amps _____

Location (of Primary Supply Panelboard): _____

Disconnecting Means Location: _____ b. Secondary (Standby):

_____ Storage Battery: Amp-Hr. Rating _____

Calculated capacity to operate system, in hours: _____ 24 _____ 60 _____

_____ Engine-driven generator dedicated to fire alarm system:

Location of fuel storage: _____

TYPE BATTERY

☐ Dry Cell
☐ Nickel-Cadmium
☐ Sealed Lead-Acid
☐ Lead-Acid
☐ Other (Specify): _____ c. Emergency or standby system used as a backup to primary power supply, instead of using a secondary power supply:

_____ Emergency system described in NFPA 70, Article 700

_____ Legally required standby described in NFPA 70, Article 701

_____ Optional standby system described in NFPA 70, Article 702, which also meets the performance requirements of Article 700 or 701.

(NFPA Inspection and Testing 2 of 4)

FIG. 11B

1103

PRIOR TO ANY TESTING

| NOTIFICATIONS ARE MADE | Yes | No | Who | Time |
|---|---|---|---|---|
| Monitoring Entity | ☐☐ | | | |
| Building Occupants | ☐☐ | | | |
| Building Management | ☐☐ | | | |
| Other (Specify) | ☐☐ | | | |
| AHJ (Notified) of Any Impairments | ☐☐ | | | |

SYSTEM TESTS AND INSPECTIONS

| TYPE | Visible | Functional | Comments |
|---|---|---|---|
| Control Unit | ☐☐ | | |
| Interface Eq. | ☐☐ | | |
| Lamps/LEDS | ☐☐ | | |
| Fuses | ☐☐ | | |
| Primary Power Supply | ☐☐ | | |
| Trouble Signals | ☐☐ | | |
| Disconnect Switches | ☐☐ | | |
| Ground-Fault Monitoring | ☐☐ | | |
| **SECONDARY POWER** | | | |
| **TYPE** | **Visible** | **Functional** | **Comments** |
| Battery Condition | ☐ | | |
| Load Voltage | | ☐ | |
| Discharge Test | | ☐ | |
| Charger Test | | ☐ | |
| Specific Gravity | | ☐ | |
| **TRANSIENT SUPPRESSORS** | ☐ | | |
| **REMOTE ANNUNCIATORS** | ☐☐ | | |
| **NOTIFICATION APPLIANCES** | | | |
| Audible | ☐☐ | | |
| Visual | ☐☐ | | |
| Speakers | ☐☐ | | |
| Voice Clarity | | ☐ | |

INITIATING AND SUPERVISORY DEVICE TESTS AND INSPECTIONS

| Loc. & S/N | Device Type | Visual Check | Functional Test | Factory Setting | Meas. Setting | Pass | Fail |
|---|---|---|---|---|---|---|---|
| | | ☐ | ☐ | | | ☐ | ☐ |
| | | ☐ | ☐ | | | ☐ | ☐ |
| | | ☐ | ☐ | | | ☐ | ☐ |
| | | ☐ | ☐ | | | ☐ | ☐ |
| | | ☐ | ☐ | | | ☐ | ☐ |
| | | ☐ | ☐ | | | ☐ | ☐ |

Comments: _____

(NFPA Inspection and Testing 3 of 4)

FIG. 11C

1104

| EMERGENCY COMMUNICATIONS EQUIPMENT | Visual | Functional | Comments |
|---|---|---|---|
| Phone Set | ☐ | ☐ | _____ |
| Phone Jacks | ☐ | ☐ | _____ |
| Off-Hook Indicator | ☐ | ☐ | _____ |
| Amplifier(s) | ☐ | ☐ | _____ |
| Tone Generator(s) | ☐ | ☐ | _____ |
| Call-in Signal | ☐ | ☐ | _____ |
| System Performance | ☐ | ☐ | _____ |

| INTERFACE EQUIPMENT | Visual | Device Operation | Simulated Operation |
|---|---|---|---|
| (Specify) _____ | ☐ | ☐ | ☐ |
| (Specify) _____ | ☐ | ☐ | ☐ |
| (Specify) _____ | ☐ | ☐ | ☐ |
| **SPECIAL HAZARD SYSTEMS** | | | |
| (Specify) _____ | ☐ | ☐ | ☐ |
| (Specify) _____ | ☐ | ☐ | ☐ |
| (Specify) _____ | ☐ | ☐ | ☐ |

Special Procedures: _____

Comments: _____

| SUPERVISING STATION MONITORING | Yes | No | Time | Comments |
|---|---|---|---|---|
| Alarm Signal | ☐ | ☐ | _____ | _____ |
| Alarm Restoration | ☐ | ☐ | _____ | _____ |
| Trouble Signal | ☐ | ☐ | _____ | _____ |
| Supervisory Signal | ☐ | ☐ | _____ | _____ |
| Supervisory Restoration | ☐ | ☐ | _____ | _____ |

| NOTIFICATIONS THAT TESTING IS COMPLETE | Yes | No | Who | Time |
|---|---|---|---|---|
| Building Management | ☐ | ☐ | _____ | _____ |
| Monitoring Agency | ☐ | ☐ | _____ | _____ |
| Building Occupants | ☐ | ☐ | _____ | _____ |
| Other (Specify) | ☐ | ☐ | _____ | _____ |

The following did not operate correctly: _____

System restored to normal operation: Date: _____ Time: _____

THIS TESTING WAS PERFORMED IN ACCORDANCE WITH APPLICABLE NFPA STANDARDS.

Name of Inspector: _____ Date: _____ Time: _____

Signature: _____

Name of Owner or Representative: _____

Date: _____ Time: _____

Signature: _____

(NFPA Inspection and Testing 4 of 4)

FIG. 11D

METHOD AND APPARATUS FOR AUTHENTICATED ON-SITE TESTING, INSPECTION, SERVICING AND CONTROL OF LIFE-SAFETY EQUIPMENT AND REPORTING OF SAME USING A REMOTE ACCESSORY

CROSS-REFERENCE TO RELATED APPLICATIONS

The present invention is related to and claims priority from U.S. Provisional Application No. 60/849,478 filed Oct. 5, 2006, the contents of which are incorporated herein by reference.

DESCRIPTION OF THE INVENTION

1. Field of the Invention

The present invention relates generally to authenticated testing of life-safety equipment such as smoke detector, fire alarm, and sprinkler systems and more particularly, to providing an authenticated test report and other authenticated test related and monitoring related metrics for a life-safety equipment, such as a fire alarm control panel for facilitating on-site walkabout testing, inspection, installation, servicing, and control of fire alarm systems.

2. Background of the Invention

The installation and maintenance of life-safety equipment such as smoke detectors, fire alarm and sprinkler systems, and the like, continues to be a major concern for existing and new commercial and residential living and working spaces. Given that, under various local ordinances (see, e.g. New Jersey State Fire Prevention Code), which are typically derived from uniform codes such as the Uniform Fire Code, published by the National Fire Protection Association (NFPA), with headquarters at 1 Batterymarch Park, Quincy, Mass. 02269, periodic maintenance must be performed in accordance with various rules common in most jurisdictions, cost control of such maintenance procedures is of great concern.

Under the codes, life safety equipment is mandated to be serviced, tested, and inspected at regular intervals as dictated by applicable codes and standards in a given jurisdiction. The life safety equipment must also be serviced and repaired within a defined period from a time of failure, defect, or activation. The life safety equipment such as fire condition sensors commonly reports to a specific location, such as an annunciator panel or control panel, which annunciates through visible and/or audible indicators the status of the equipment for given areas or locations.

When equipment is serviced, tested, and inspected persons performing this service must physically monitor the control locations for status changes. In most cases for servicing, testing, and inspecting this equipment, it is necessary for two persons to be present for this maintenance. In older control equipment that monitored large locations having zoned equipment, the need for a second person to be on site to monitor the control equipment, acknowledge events, and restore the system subsequent to indication events became even more acute. As will be appreciated, having a second person on site for these types of systems add increased labor costs, slow responses to activations, and significantly high cost.

Control equipment being placed in service today is typically microprocessor based. Such equipment maintains the ability to distinguish specific faults, alarms, or other events on a system by their specific location or response type. The current equipment is also able to process, log, and/or report multiple events simultaneously. When performing routine, periodic testing and inspection or as-needed servicing and control of life-safety equipment, much effort is concentrated on activating sensors and confirming that the activation of the sensors is detected at the main fire alarm panel for each and every sensor. Further, authentication is required for the tests such that the integrity of the system can be deemed within compliance with the code by a certified agency such as a fire inspection officer, fire marshal or the like.

Problems arise in that, even if walkabout testing can be set up to be performed by an individual, data gathered by the test must still be reduced to a report and, the report and possibly the inspection procedure itself must be authenticated to alert authorities to non-compliant facilities and to prevent the submission of substandard or even fraudulent test results.

Accordingly, is would be desirable in the art to alleviate the need for excessive manual panel interaction, to provide means for authentication of results, and to provide an authenticated report or the like in a compliant format for the jurisdiction where the facility is located.

It would be further desirable in the art to significantly decrease the amount of labor required for testing, inspecting and servicing of life safety systems; to provide constant monitoring of life safety equipment during testing, inspection, and service of life safety systems. It would also be desirable to provide persons not familiar with inspection and testing of equipment with the ability to monitor testing of systems for observing and accepting such tests; to allow persons interacting with system events the ability to monitor changes in status while investigating events in areas away from the control components; to allow persons interacting with system events the ability to monitor additional events while away from control components.

It would be still further desirable to decrease the time required to respond and investigate additional events in the facility by the instantaneous transmission of the event to the person on site; to allow persons not familiar with specific makes and models of control equipment to view events while away from the control panel, and the like.

While a general background including problems in the art are described hereinabove, with occasional reference to related art or general concepts associated with the present invention, the above description is not intending to be limiting since the primary features of the present invention will be set forth in the description which follows. Some aspects of the present invention not specifically described herein may become obvious after a review of the attendant description, or may be learned by practice of the invention. Accordingly, it is to be understood that both the foregoing general description and the following detailed description are exemplary and explanatory only in nature and are not restrictive of the scope or applicability of the present invention.

BRIEF DESCRIPTION OF THE DRAWINGS

The accompanying drawings, which are incorporated in and constitute a part of this specification, illustrate embodiments of the invention and together with the description, serve to explain the principles of the invention. Thus, with reference to the drawings:

FIG. 11A is a diagram illustrating a page of an exemplary authenticated test report form consistent with embodiments of the present invention;

FIG. 11B is a diagram illustrating an additional page of an exemplary authenticated test report form consistent with embodiments of the present invention;

FIG. 11C is a diagram illustrating another additional page of an exemplary authenticated test report form consistent with embodiments of the present invention; and FIG. 11D is a diagram illustrating still another additional page of an exemplary authenticated test report form consistent with embodiments of the present invention.

DESCRIPTION OF THE EMBODIMENTS

Figure 1:
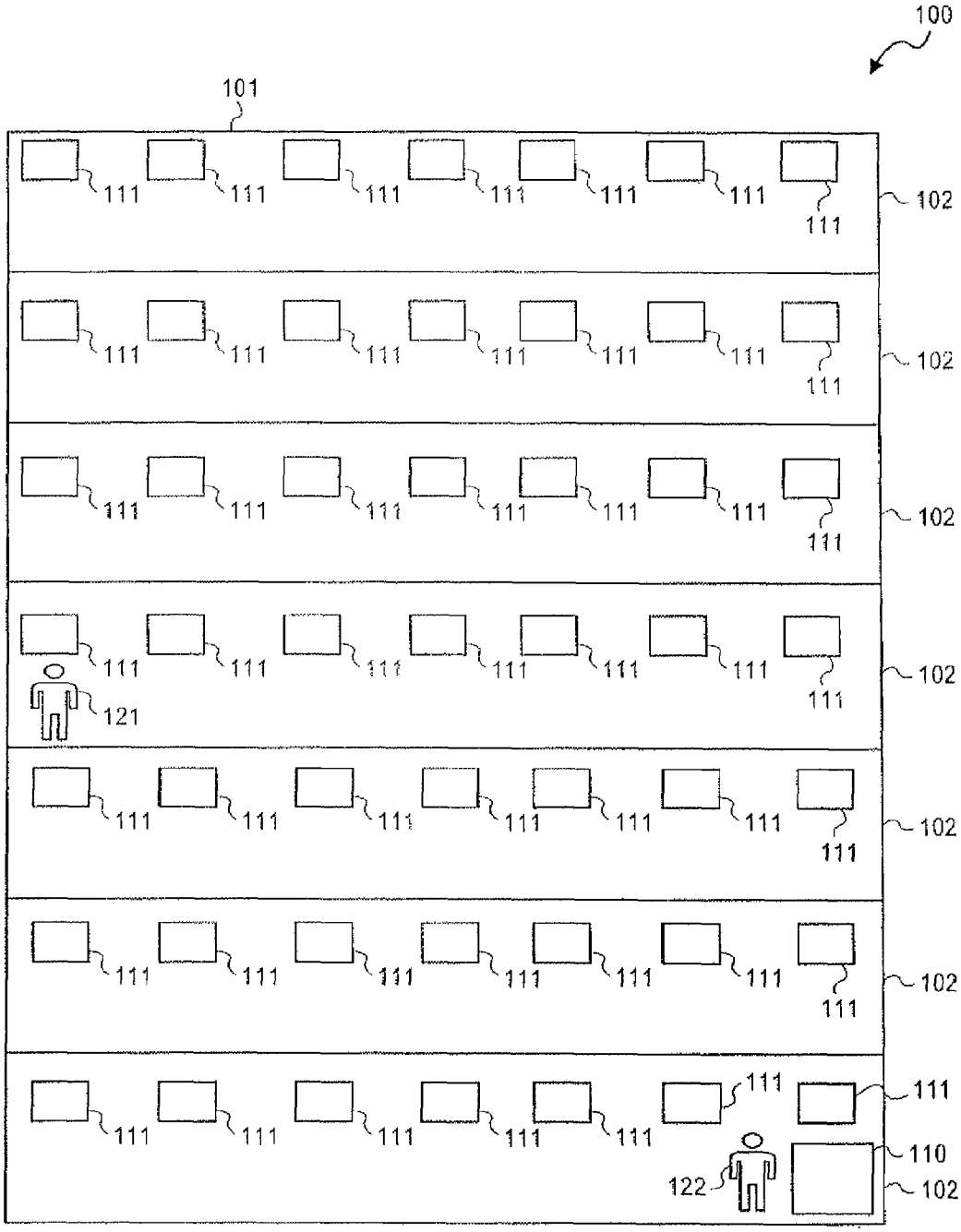
FIG. 1 PRIOR ART
FIG. 1 is a diagram illustrating a conventional facility testing scenario requiring at least two persons to conduct life safety testing evolutions.

In accordance with various embodiments, the exemplary method and apparatus can be characterized generally according to the following description. The various embodiments described herein result in a method and apparatus to assist building owners, fire officials, testers of life safety and/or fire alarm systems, and companies that service life safety and/or fire alarm systems. The various embodiments described herein allow for a network-based, authenticated fire alarm inspection. In accordance with the invention, upon completion of an inspection evolution, fire inspectors receive a printout having content and in a format that is approved and recommended by the NFPA when a system has ultimately passed. Alternatively, the invention can provide proper forms for submitting authenticated information as to why a system has failed. During the inspection, a tester of the system can be asked questions necessary for providing authenticated information in, for example, a yes/no format or short answer format, which answers will provide a resulting inspection evolution having a wealth of information for display or other output format that is authenticated and suits the needs of the user. By providing information in such a format, fire inspectors have the ability to view, for example, an online history of previous test results and thus can determine what testing needs to be completed to comply with fire codes.

In accordance with various embodiments of the invention, a service company can review authenticated reports containing information, notes, recommendations and the like, provided by testers while performing inspection evolutions. Thus, using the information from the reports, a service company can provide accurate quotes for necessary work. The information and other information such as pictures can be provided in the report facilitating the procurement of proper parts and other work estimates. Further in accordance with the invention, a service company can gain valuable time and reduce manpower requirements by allowing single person walkabout testing or by allowing two or more testers to perform an inspection at a time. The service company manager can monitor how much work each tester is accomplishing during the day for calculating various evaluation and performance metrics. An exemplary system in accordance with the invention can reduce the need for highly skilled and often overqualified personnel or technicians to be used to perform testing associated with a given site and can allow less qualified and thus less expensive labor resources to be used to perform tests. By providing authenticated testing and report generation, the present invention provides an end user such as a service company a more accurate, more thorough and less costly way of performing testing and generating authenticated reports that are compliant with local regulations.

Further advantages can be provided in that building owners can opt for less interruption of building access and disruption of daily routines since mandatory inspections can be performed with more testers and thus can be completed in less time. Building owners are further provided with authenticated results generated during life safety system testing. With authenticated results, a building owner will know quickly and with certainty whether any issues are present with regard to life-safety equipment. Authenticated test result data can be provided in an easy to view format that will reduce a sense of helplessness a building owner may experience at the hands of life-safety testers, service companies and fire officials and allow the building owner to rapidly resolve outstanding issues with a minimum of confusion.

It should be noted that various terms are used herein which may be understood from the following explanations. The term "tester" as used herein can refer to a person who is testing the life safety/fire alarm safety apparatus of a particular building. The term "inspector" as used herein can refer to a Fire Official or inspector such as someone who is responsible through authority bestowed by the town, municipality, county, state or other governmental agency or body, to certify that life safety/fire alarm safety equipment associated with a building is properly maintained and inspections are up to date and in conformance with any local, state, federal or other regulations. The term "service company" can refer to a company contracted by management of a building to perform testing on the fire alarm system. The service company may also be requested to perform maintenance on or make recommendations associated with the life safety/fire alarm safety equipment so as to bring the equipment into conformance with safety codes. The term "building owner" can refer to a person or entity that owns a building and who is responsible for maintaining and/or testing the fire alarm equipment in their building. The term "conventional system" can refer to a fire alarm system that does not have fire alarm devices, such as sensors or the like, having unique IDs. In conventional systems, devices are often daisy chained and thus if one device in a loop is activated, the entire loop registers as activated at the control panel.

It should be noted that the acronym NFPA, as used herein, refers to the National Fire Protection Association. Information about NFPA can be found at 'www.nfpa.org'. The NFPA was established in 1896, and serves as the world's leading advocate of fire prevention and is an authoritative source on public safety. NFPA promulgates nearly 300 codes and standards influencing every building, process, service, design, and installation in the United States, as well as many of those used in other countries. NFPA focuses on true consensus among members, which has helped the code-development process earn accreditation from the American National Standards Institute (ANSI). While NFPA codes may be adopted in some jurisdictions, other codes, including more stringent codes can also be used in certain areas. Thus, the present invention can be adapted to reflect whatever code is being used by a given locality, municipality, or the like. Lastly, the term "tag" can refer to a designator, label, number, or other indicia or object placed on or otherwise imprinted or emblazoned into a piece of equipment that enables the devices to be uniquely identified. A tag can include but is not limited to a bar code, a string of characters, a radio frequency identification (RFID) device, and the like.

With reference to FIG. 1, it can be seen that in a conventional scenario 100, a walkabout test of life safety equipment such as panel 110 and sensors 111 in a facility 101 requires two persons 121 and 122. Given that the facility 101 would typically include floors 102, even a single floor 102, two persons 121 and 122 are required to perform the walkabout test. One person 121 must go to various ones of sensors 111, which can include, for example, a pull station, a smoke detector, heat detector, or the like, and activate the sensor 111, while the other person 122 remains at the panel 110 to monitor and record the results associated with the activity of the one person 121. In a simple case, there is no communication between the persons 121 and 122 and results must be examined at the end of the walkabout test when the one person 121 has presumably activated all sensors in the facility 101. In other scenarios, the two persons 121 and 122 can communicate using a communications means including for example, two way radios or walkie-talkies, a wired annunciator channel or the like that may be provided in connection with the life safety equipment, or other equipment. In such a case, the results of the tests can be known by both persons 121 and 122 in real time, that is, as the walkabout test is being performed. As previously noted however, disadvantages of the conventional two-person model include the expense and inconvenience of a second person being needed to read the alarm panel during activation of sensors or stations, clear alarms, report the success or failure of various tests and the like.

Figure 2:
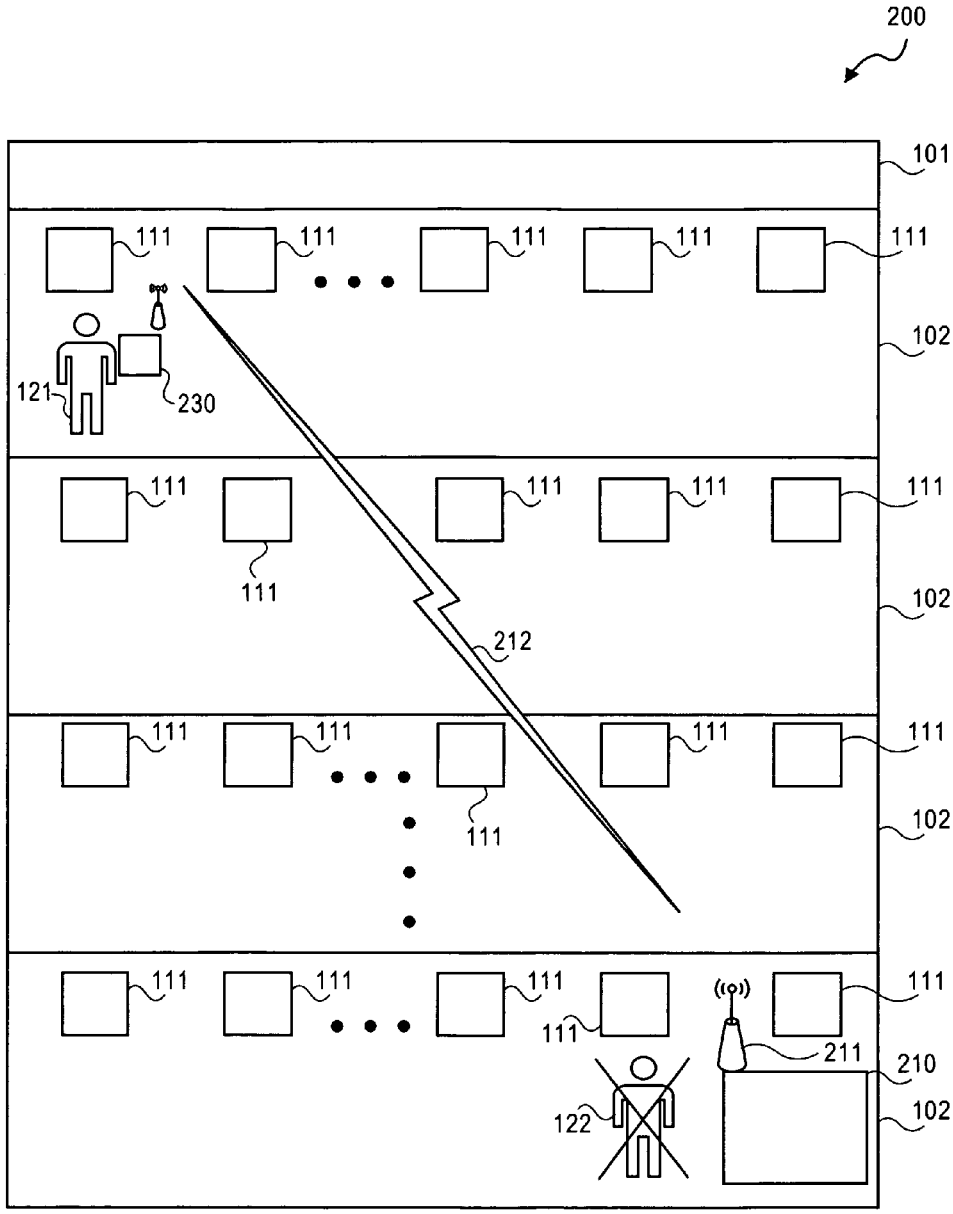
FIG. 2 is a diagram illustrating an exemplary scenario for reducing a manpower requirement for conducting life safety testing evolutions using a remote accessory consistent with various embodiments of the present invention.

It is therefore desirable to provide a system that is able to support the performance of a single-person walkabout scenario 200 as shown in FIG. 2. In such a case, the other person 122 can be eliminated from the testing environment since a panel 210 can be equipped with a wireless interface 211 capable of transmitting information associated with the in-progress test, and other information, over a wireless link 212 to the one person 121, who is free to traverse the floors 102 of the facility 101 at as rapid a pace as the ability to confirm test results will allow. It will be appreciated that the one person 121 can be equipped with a wireless device 230 that can communicate with the panel 210 to provide, for example, a visual display of the information generated by the panel 210 regarding the results of the test and any other information that may be available such as, for example, the make-up of the facility 101 including the type and number of sensors 111, their location, and the like.

Figure 3:
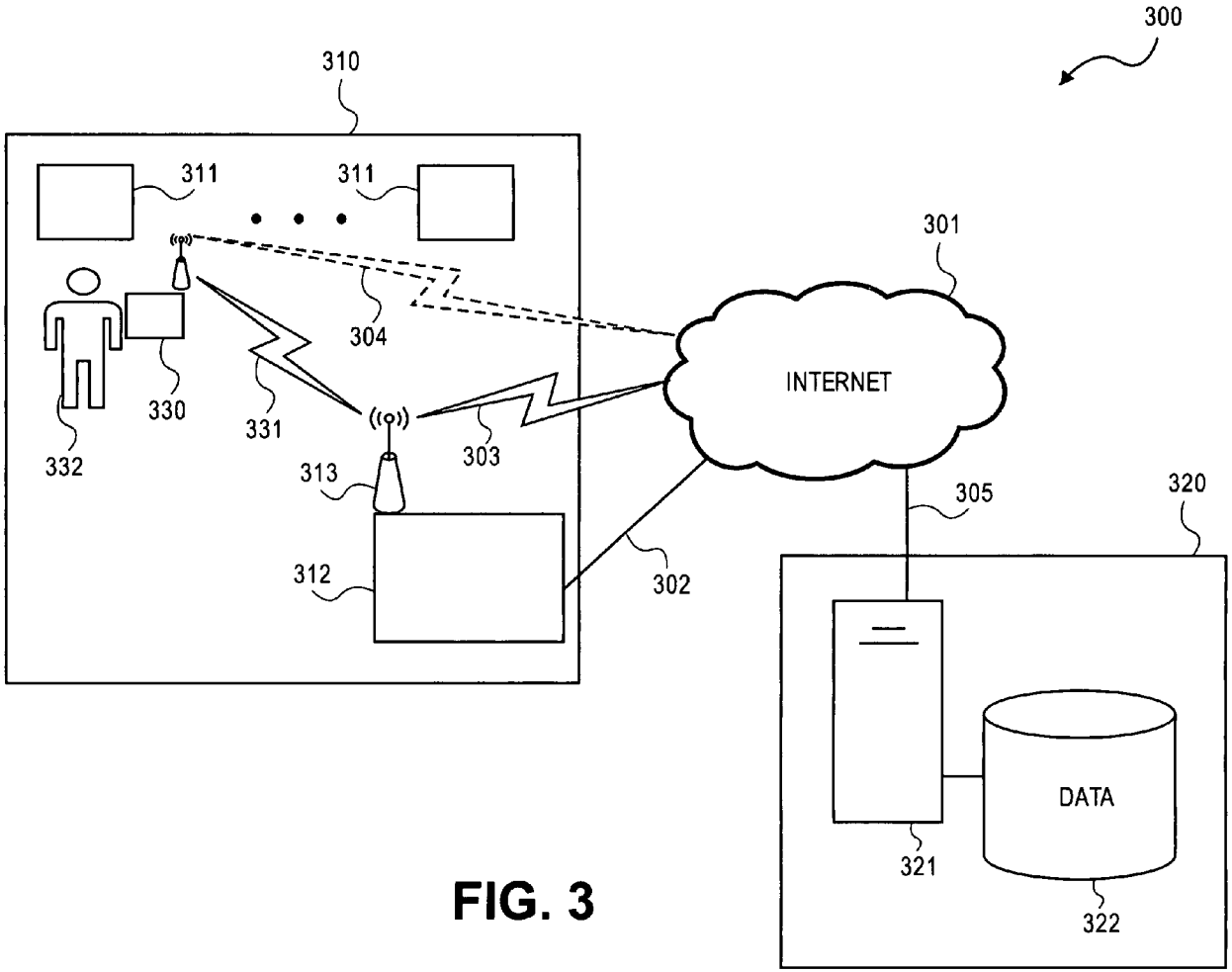
FIG. 3 is a diagram illustrating an exemplary scenario using a network for providing various wired and wireless connections to components consistent with embodiments of the present invention.

In accordance with still other examples, a network scenario 300 as shown in FIG. 3, can be established through a network connection facilitated by a network or network fabric such as network 301, which can be a public network such as the Internet, or a private network, or the like. An entity such as, for example, a municipal life safety authority, fire department, fire marshal's office, could be envisioned as hosting a testing or certification facility 320 having a certification or authentication server 321 and a data store 322 for connecting with members or users, such as facility managers or life-safety officers and storing information associated with a facility such as facility 310. Alternatively, the certification facility could be hosted by a private entity such as a property management company or the like, where a multitude of private facilities can connect to the certification facility 320 for providing authenticated or certified or certificated tests. The certification facility 320 can be connected to a network 301 such as the Internet through a connection 305, which is preferably a high capacity or broadband connection, such as a wired connection or fiber optic connection or the like. It would also be conceivable that the certification facility 320 could be connected to the network 301 through a high-capacity wireless link governed by a wireless protocol, such as a WiFi link, or other wireless network connection governed by an associated protocol.

The facility 310 can include a panel 312 with a wireless interface 313, which can be used to connect to one or more of a wireless device 330 through a link 331, the network 301 through a wireless network connection 303 and/or a hardwired connection 302, which can be a telephone line, a coaxial cable connection, a fiber optic link or the like. Alternatively, the wireless device 330 can connect directly to the network 301 through a wireless interface 304. Thus, in scenario 300 and in other scenarios, a person 332, can perform walk-about testing while monitoring results on the wireless device 330. At the same time, the certification facility 320 can provide information about the facility 310 to the person 332 via wireless device 330 the contents of which can be provided directly from the certification facility 320 through the network 301 and the wireless interface 304, or can be provided through the panel 312 and the link 331 once the panel is connected to the certification facility 320 through, for example, the hardwired connection 302 or the wireless network connection 303. It will be appreciated that, while in the present example, one person 332 is shown, several testers can independently conduct tests at the same time using respective wireless devices as will be explained in greater detail hereinafter.

Figure 4:
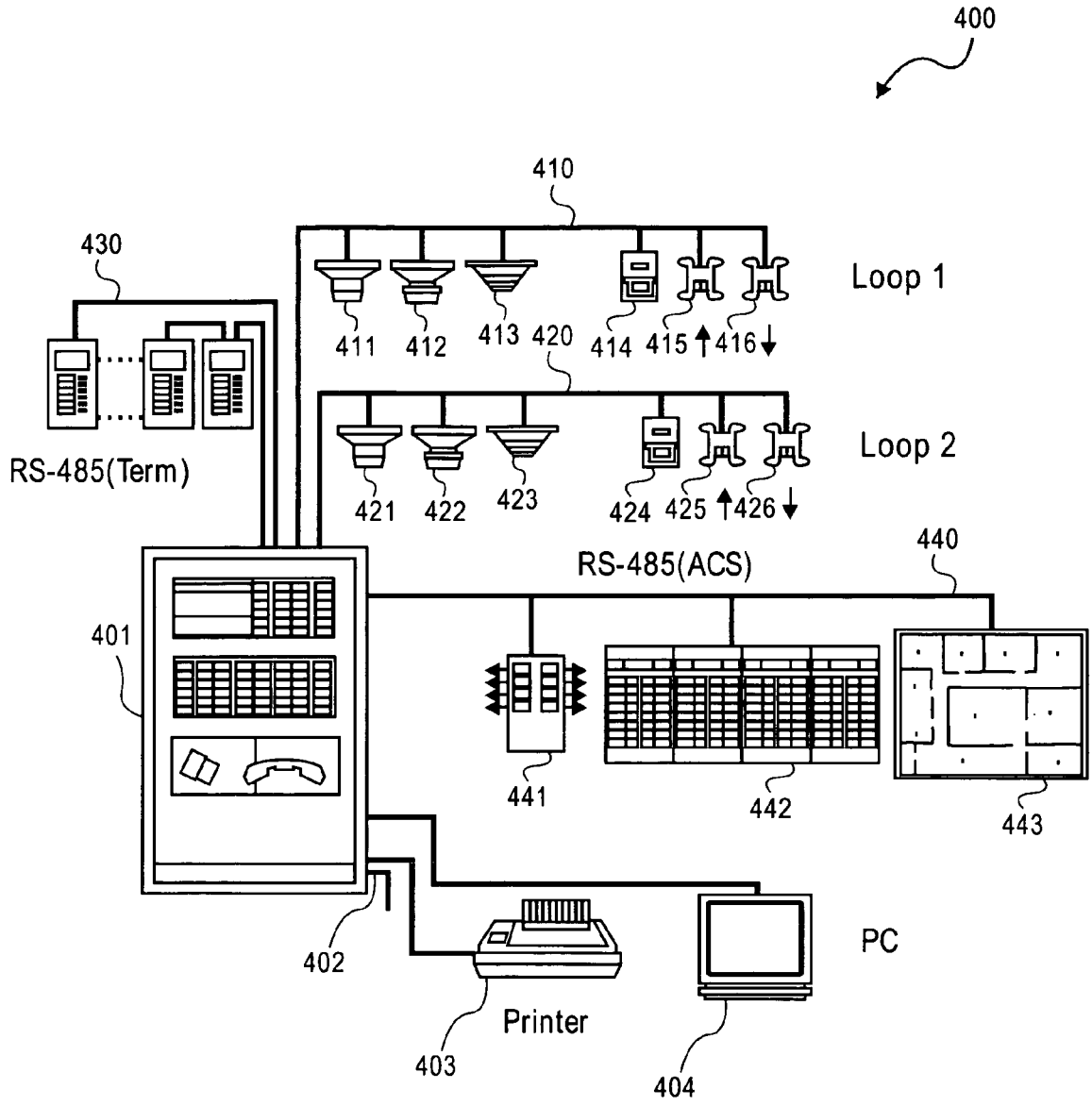
FIG. 4 is a diagram illustrating various components of a life safety system including alarm loops, auxiliary panels and terminals consistent with embodiments of the present invention.

To better understand the invention, a scenario 400 including the configuration of a typical alarm panel 401 and associated equipment is shown in FIG. 4. As will be appreciated, the alarm panel 401 can be coupled to a phone link or the like and can be provided with inputs and outputs to facilitate the input and display of information such as port 402, printer 403, and display 404. The alarm panel 401 can further be connected to various sensor loops such as a Loop 1 410 and a Loop 2 420. Loop 1 410 can be equipped with various stations such as sensors 411, 412, and 413 and pull stations such as stations 414, 415, and 416. Similarly, Loop 2 420 can be equipped with various stations such as sensors 421, 422, and 423 and pull stations such as stations 424, 425, and 426. The arrangement and constitution of loops will depend on the characteristics of the facility. For example, in a large facility, it is possible for a loop to be provided for, for example, each floor or even several loops per floor. In a smaller facility, all sensors may be on a single loop. In addition to station and/or sensor loops, such as Loop 1 410 and Loop 2 420, remote terminals 430 can be provided for performing remote control of at least certain functions of the panel 401. The remote terminals 430 can be connected to the panel 401 in a terminal mode, using a daisy chain of serial port connections such as that specified by the Electronic Industry Association (EIA) in the EIA-485 standard formerly known as the RS-485 standard. The panel 401 can be equipped with several EIA-485 serial ports and thus can support additional devices such as annuciators 441, 442, and 443 for example, in an open loop mode.

Figure 5:
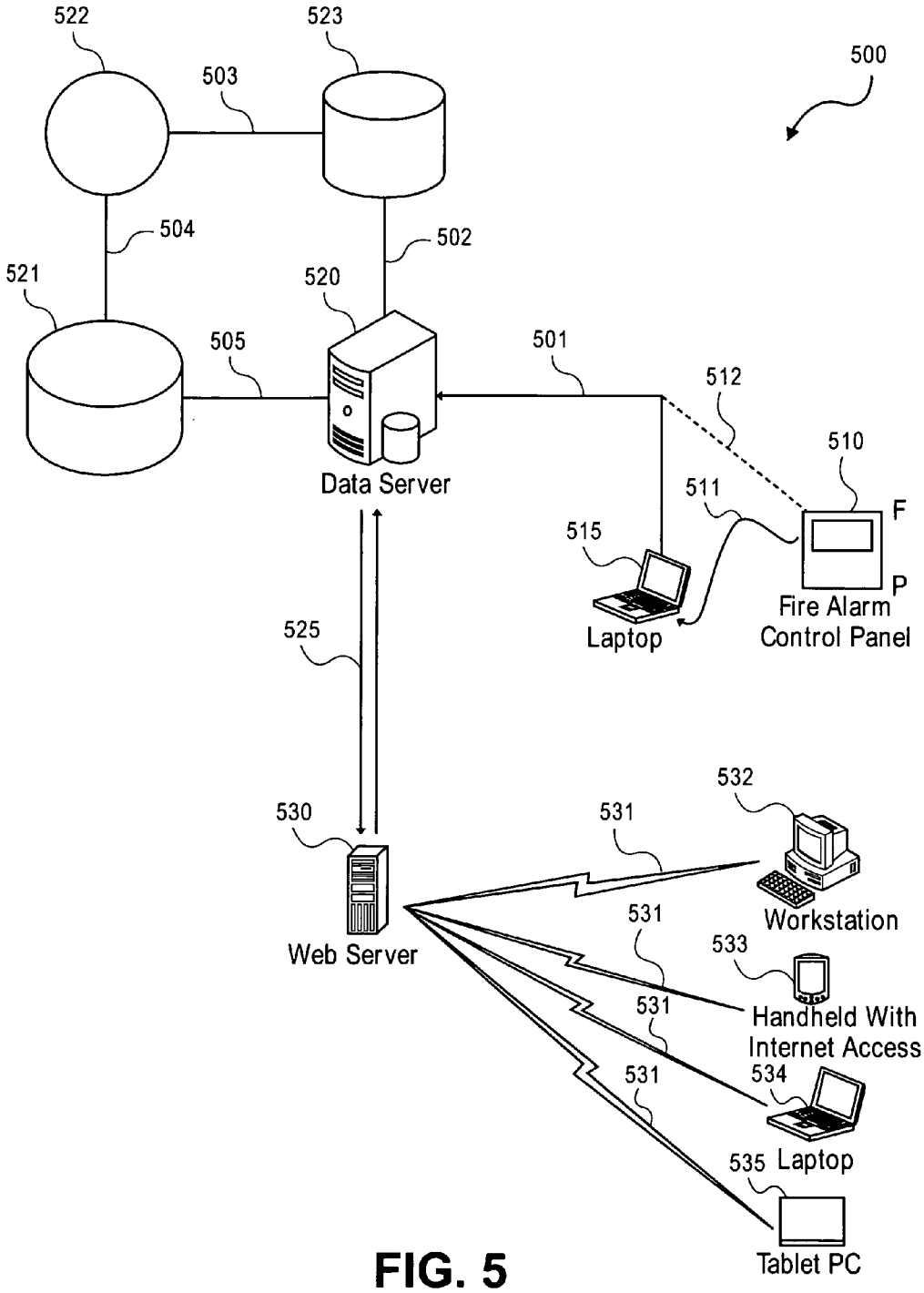
FIG. 5 is a diagram illustrating various components of a life safety system in a network environment including servers, terminals, and data storage consistent with embodiments of the present invention.

In accordance with various embodiments, an exemplary scenario 500 is shown in connection with FIG. 5, where it can be seen that a system typically consists of two basic sub parts. The first part is centered around a web server 530, which can be configured to accept input from and transfer information over a wireless link 531 to wireless devices such as devices 532-535 which can be a workstation, a handheld computer, a laptop computer, a tablet personal computer, or the like. The devices can be used to input information about a fire alarm system that is under test such as through a fire alarm control panel 510 or through an external network connection to a server or a hosting device, such as web server 530 as will be described. A data server 520 can be connected to the fire alarm control panel 510 through a connection 511, which can be a wireless connection, with a terminal such as a laptop 515 and also, optionally, through a dedicated link 512. In accordance with various embodiments, a connection or communication session can be established between the data server 520 and the fire alarm control panel 510 such as can be facilitated by a connection 501 between the laptop 515 and the data server 520. It will be appreciated that the data server 520 and the web server 530 can establish a connection 525, which can be a wireless or wired connection governed by a protocol. A connection or communication session can also be established between the web server 530 and portable devices such as devices 532-535 as described above. In various exemplary embodiments, the web server 530 can host, for example, a web page to which the devices 532-535 can connect and engage in an interactive session to input information and view the status of alarm devices and the like. In alternative embodiments, the web server 530 can provide alerts that can be broadcast to devices that are not currently connected, through email or through an active means such as a page or wireless telephone or two-way radio call. Also, the web server 530 can provide code specific pages to the devices 532-535 in order to input various information associated with devices under test and the like. The devices 532-535 can also be equipped with an application that has a background process to monitor for such alerts and, when received, can provide an indication of the alert such as a tone or other audible alert, a vibration alert or the like.

In an exemplary test scenario a tag is preferably affixed or otherwise applied or associated with each alarm station or sensor in the alarm system, which can be referred to as an alarm device. The tag can be numerical or any other type of identifier as long as it is applied to or marked on each alarm device. When tags are initially applied to an alarm device, such as during system installation or retrofit, information about the device can be entered into a repository such as data store 521 which is connected to data server 520. The information can include the type of the alarm device, such as a smoke detector, heat detector, or the like along with a brief description of any additional information such as the location of the alarm device. Additional auxiliary data can also be stored in a remote node 522 or remote data store 523, all of which can be accessed and data retrieved therefrom such as through connections 502, 503, 504 and 505. Activation information for the various alarm devices that occur during tests or during normal operation, such as genuine alarms can also be stored and logged as events including the device information and the date and time of the activation event.

Alarm device verification can be conducted as follows. An inspector scans or otherwise enters information associated with the tag, which action will alert the system that the particular alarm device is to be placed into an alarm condition by the tester or inspector. The web server 530 communicates with the data server 520 to input alarm device information into the appropriate fields of the authentication form as will be described in greater detail hereinafter. When an appropriate zone, loop, or other indicia is activated for that alarm device, for example, within a specified time, the alarm device will be recorded as successfully passing the test. As will be described in greater detail hereinafter, the appropriate questions will be asked of the tester in connection with the alarm device to complete the authentication procedure.

It should be noted that the tag that is created or otherwise generated for or associated with the alarm devices can be automatically generated by, for example, the data server 520 and can then, for example in the case of labels, be printed locally by the inspector on a printer or labeling device as the alarm devices are initially tested and information recorded. Another aspect of the inventive authentication using the labeling as described above, includes the use of labeling during testing of devices where codes require devices be marked, labeled, or otherwise tagged manually in the course of testing. Accordingly, when testing alarm devices or other devices such as sprinkler water flow switches during a quarterly flow test, the data server 520 can generate a label for each device showing the inspected date, inspector, time and date tested, and any other information. An inspector can affix such a label to the tags where necessary to manually certify that each inspection was properly conducted and that each alarm device or other unit operated as expected. The labeling and manual authenticating would be in addition to the automatic reporting and authentication as described herein.

It will be appreciated that the present invention is contemplated such that multiple testers can perform inspections by accessing, for example, data server 520 from multiple web browsers such as from devices 532-535 at one time. Also, while one web server 530 is shown, it is also contemplated that many web servers 530 could be used to access data server 520 to perform multiple inspections on multiple sites by multiple testers at one time, subject, of course, to ordinary delays caused by the demands for access generated by the multiple inspectors or testers. It should be noted that the test data generated from the tests can be stored as described such that the test data can be provided into standard forms required by jurisdictions for reporting information such as inspection status, test results and the like. The data and authenticated forms can be used to provide notification to a building owner of inspections required during a particular time frame, notification of upcoming inspections and scheduling of upcoming inspections through calendars or other schedule management tools. The data can also include inventories of equipment or the like.

Since the operation of an exemplary system in accordance with the invention requires intensive communication, a better understanding can be gained with reference to the various communication channels by providing exemplary specifications for such channels. It will be appreciated that the specifications are exemplary in nature for illustrative purposes and other specifications can be used in accordance with the invention.

For basic information output from the fire alarm control panel 510, a unidirectional serial channel such as an RS-232 communications channel can be used to connect a portable computer or other device such as laptop 515 thereto. Alternatively, a dedicated server can be coupled to the alarm panel to provide a network connection to the alarm panel such that a permanent connection can be available to, for example, the web server 530 or central monitoring facility. The output is most often the existing printer port of the fire alarm control panel but could be any communications port. Thus the interface to the port can include, for example, a software application or driver configured to emulate a printer and capture data as it is transmitted from the fire alarm control panel 510. The laptop 515 can transmit data and receive an acknowledgement that the data has been received from the data server 520 using a standard network connection 501 such as an Internet connection using a TCP/IP protocol known in the art. Data server 520 can store data received from the network connection 501 locally such as in data store 521 and can also process the data and store the processed data in the data store 521. Web server 530 can connect to data server 520 to collect stored inspection and test data. The processed data such as the results of an alarm device test can be accessed by web server 530 for dissemination to remote wireless devices. A network connection can also be established between web server 530 and portable devices to be used during testing such as devices 532-535. Forms and inspection data that can be hosted on web server 530 can be completed during testing.

In addition to the operations described, laptop 515 can also store intermediate data received from control panel during the course of testing and prepare and transmit the data to data server 520. The laptop 515 can delete locally stored activity upon successful login at data server 520. Data server 520 can further sort all data received in local disk or other storage media such as auxiliary store 523 and can process stored data in accordance with applicable codes and standards as defined by software or as configured based on building location and jurisdiction. Web server 530 can retrieve stored data from data server 520 and display stored test data, including information associated with all alarm devices tested, control component information, and the like on remote devices such as devices 532-535. Web server 530 can further display, via remote devices, specific questions from applicable codes and standards needed for certifying or otherwise authenticating the test or information for the particular type of alarm device. A user must answer the questions in order to certify or otherwise authenticate the alarm device under test.

Web server 530 transmits responses to questions to data server 520 where an authentication report is automatically generated in standard form as suggested and recommended by applicable codes and standards. It should be noted that devices 532-535 can be used to inventory alarm devices during testing as can also be used to input information for alarm devices, control equipment, and peripheral devices during installation in a facility. Devices 532-535 can also be used to make notes and record observations and input non-standard or out-of-band test data during the course of the inspection. All collected data from devices 532-535 can be transmitted and stored on the web server 530, which can further transmit data to data server 520 for storage in data store 521.

It should also be noted that multiple devices 532-535 may be used simultaneously during the course of testing. Users preferably have visual access to the entire up-to-date inspection report with all devices marked that have been successfully tested by all users. Users are able to then select any remaining alarm devices to be tested, installed or the like, and answer questions. In addition to including portable devices, devices 532-535 can include a dedicated workstation with internet access that can be used, for example, by inspection managers, inspectors, facility managers, fire officials, or other persons who may be interested in the information collected, to access complete inspections and view progress reports on inspection status, where inspections are in progress. Workstations can also be used to schedule inspections due over the course of coming time for periods as required, to set dates for required inspection and receive reminders of inspections due and the like.

In accordance with various alternative exemplary embodiments, laptop 515 is a computer that is attached to the fire alarm control panel 510 and provides information to data server 520 and to web server 530. Devices 532-535 do not communicate directly with laptop 515. The system is not contemplated as involving bidirectional communication however it can be practiced on channels that allow bidirectional communication provided there is no direct communication between devices and the alarm control panel regarding test results or the like. Such a configuration is advantageous in that objectivity is maintained and the overall system database merely combines or otherwise accumulates the information provided by users associated with devices 532-535 and by laptop 515. If a user determines that information provided by the system is incorrect, such as an association between an alarm device and a test status for that alarm device, the user can cancel the association, such as by cancelling the test, and performing the test again. However in order to maintain the ability to authenticate, which requires certifiable objectivity, a user can never force any associations to occur through direct communication.

Figure 6:
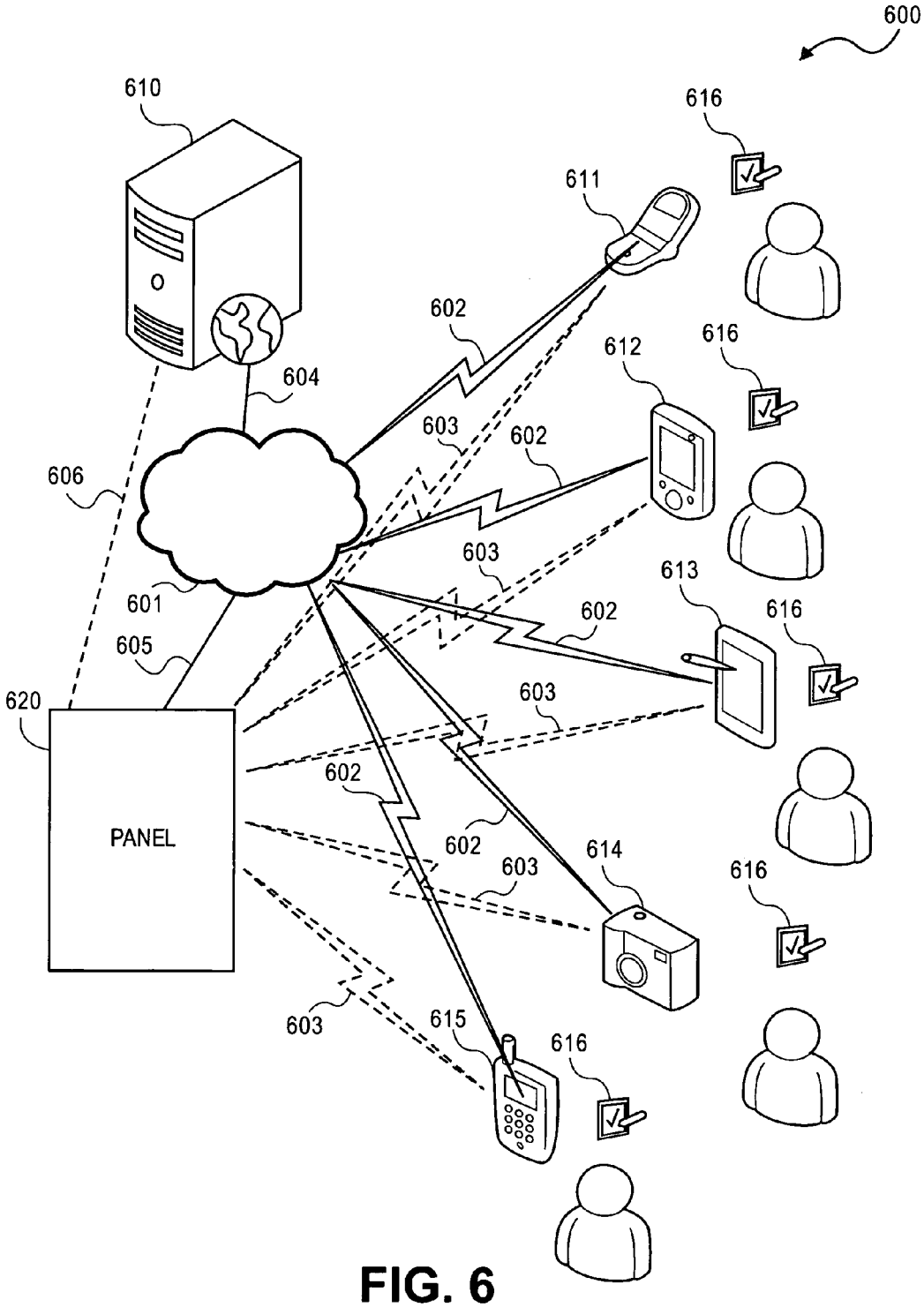
FIG. 6 is a diagram further illustrating various components of a life safety system in a network environment including a panel, an alarm server, and remote accessories consistent with embodiments of the present invention.

It will be appreciated from a review of FIG. 6, that many devices, such as wireless devices 611-615 can be used to provide input and receive data such as forms and the like in accordance with the invention. A web server 610 can be used to provide information to and from devices, preferably across a network connection 604 to a network 601, which can be a public network such as the internet or the like or a private network. An alarm control panel 620 can be connected to the web server 610 through a connection 605 to the network 601 or can be directly connected to the web server 610 through direct connection 606, which can be in addition to or in lieu of the connection 605. The wireless devices 611-615 can be connected to the network 601 through, for example, a wireless access point such as a router (not shown), which provides a wireless connection 602 to the wireless devices 611-615. Alternatively, or in addition, the wireless devices 611-615 can be connected to the alarm control panel 620 through wireless links 603 provided, for example, by a wireless interface device (not shown) integrated with or attached to alarm control panel 620. It will be appreciated that the wireless interface device can be provided in a number of different ways including being provided by a wireless enabled laptop, a wireless enabled access point or router, or the like connected to the alarm control panel 620.

The wireless devices 611-615 can include a variety of different devices, such as a two way radio 611 or combined two way radio/cell phone, a personal digital assistant (PDA) 612, a tablet PC 613, a digital camera 614, a cell phone 615 or some combination of the described devices or other devices provided that the devices are wireless enabled and have the ability to provide input to the authentication system, such as a camera, scanner, or the like, or display output from the authentication system as described herein. It will be appreciated however, that the devices preferably can, at a minimum, display information such as data entry forms and report forms as will be described.

Figure 7:
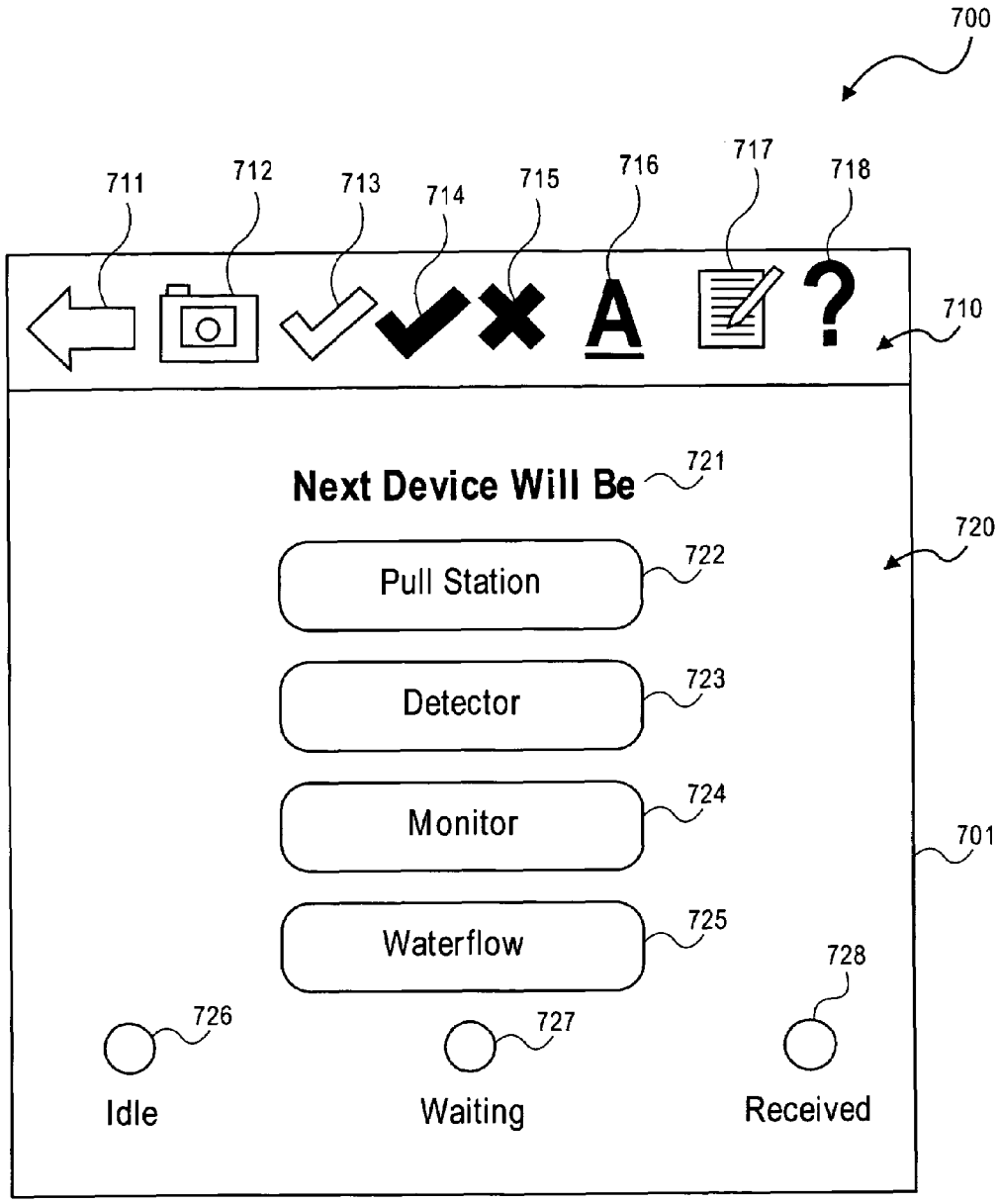
FIG. 7 is a diagram illustrating a screen of a user interface for interacting with an authentication server in connection with testing a life safety system in a network environment including a remote accessory consistent with embodiments of the present invention.

With reference to FIG. 7, an exemplary screen scenario 700 is shown for display on a remote wireless device as can be used in connection with the present invention. Before an alarm device is triggered during test evolution such as a walkabout test, an inspector, tester, or any authorized user having a wireless enabled device capable of display and input, can input the type of device being tested in a screen such as screen 701. The screen 701 can have a toolbar or menu bar 710 and a display pane 720 for showing information and providing data input areas, active controls or the like. The menu bar 710 can include buttons or controls such as a control 711 to invoke a Back operation such as to return to a previous screen, or the like, a control 712 to invoke a Camera, Take Picture operation or the like, a control 713 to invoke a Devices Remaining list or the like, a control 714 to invoke a Completed Devices list or the like, a control 715 to invoke a Failed Devices list or the like, a control 716 to invoke an All Devices list or the like, a control 717 to invoke a data entry form for entering any inspection notes or the like, and a control 718 to invoke a help facility or the like. The screen 701 can also have status indicators such as Idle indicator 726, Waiting indicator 727 and Received indicator 728. While the exemplary screen scenario 700 is shown in a particular configuration, it will be appreciated by one of ordinary skill, that there are a large number of possible user interface and/or screen designs that could be used without departing from the scope of the invention.

In one exemplary embodiment, the screen 701 can include information associated with what the next alarm device will be. An information box 721 can provide a prompt for the type of information being requested such as "Next Device Will Be" and several selections can be displayed in active control buttons such as a Pull Station button 722 indicating, if activated, that the next device is, for example, a pull station, a Detector button 723 indicating, if activated, that the next device is, for example, a heat detector, a Monitor button 724 indicating, if activated that the next device is, for example, a monitor, and a Waterflow button 725 indicating, if activated that the next device is, for example, a waterflow device. When no device is currently under test, the Idle indicator 726 can be activated. When one of the active controls is activated, such as by clicking with a pointing device, or moving to the desired control with a cursor control device and activating with an activation button such as an "Enter" button or the like, a time interval or window can be triggered and the Waiting indicator 727 can be activated and the Idle indicator 726 de-activated. The invocation of the time window by activating one of the alarm device selection buttons disables any other inspectors or testers associated with the particular test from attempting to test the selected device and further provides a time interval during which the system waits for an alarm indication to be registered by the selected type of device at the alarm panel which will be registered, for example, in the data server and stored. When the alarm is registered, the Received indicator 728 can be activated and the user will see, for example, a green light or the like. The inspector, tester or authorized user can then click on an active area or button associated with the Received indicator 728 or can click directly on a button or the like, such as a control icon 714 for Completed Devices. Once the alarm device result is registered, an alarm device reporting screen as will be described in connection with FIG. 8 can then be displayed.

Figure 8:
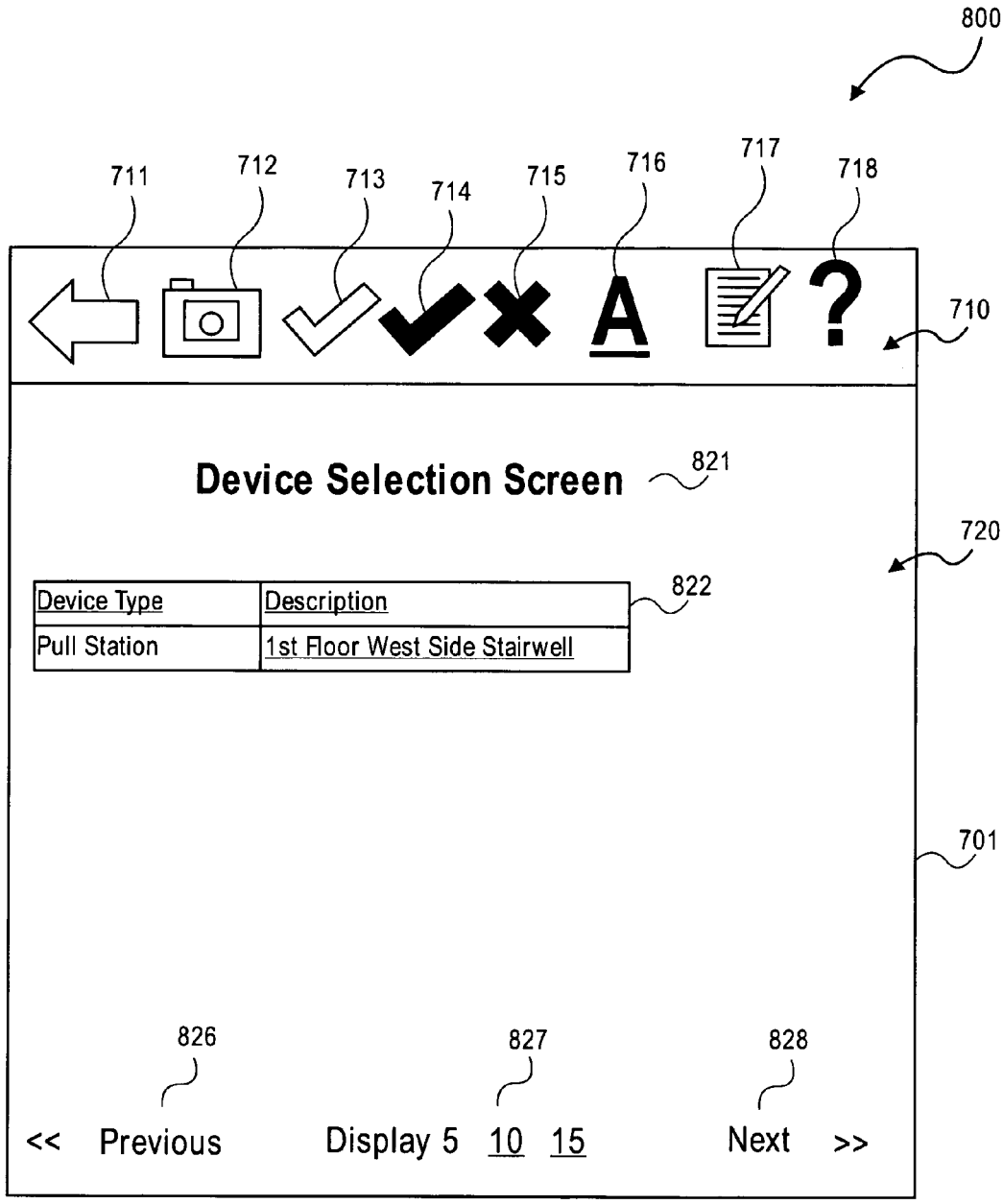
FIG. 8 is a diagram illustrating another screen of a user interface for further interacting with an authentication server in connection with testing a life safety system in a network environment including a remote accessory consistent with embodiments of the present invention.

As noted, the triggering of an alarm device will invoke a reporting screen in connection with an exemplary scenario 800, as illustrated in FIG. 8. In the display pane portion 720 of screen 701 a message, label or screen title such as Device Selection Screen can be displayed in information box 821 showing a device list 822 of devices that were triggered. The information in device list 822 indicates what alarm devices were registered by the alarm control panel and, for example, logged or otherwise stored in a data store or the like associated with a data server and forwarded to the remote wireless device through, for example, a web server or through a direct wireless connection to the remote wireless device that is displaying the screen 701. In the present example, it can be seen that a Pull Station device is shown as being activated in device list 822. If the inspector, tester, authorized user or the like believes that the device or devices shown in the device list is not the device that was activated, the inspector, tester, authorized user or the like can activate control 715 and switch, for example to a list of Failed Devices (not shown). In such an exemplary screen, the activated alarm device that did not appear in the device list 822 can be added as a failed device by inputting, for example, the type of device, location of the device, and an indication that the device appears to have failed. It should be noted that a sufficient time frame such as 5-10 seconds should be allotted during which no device activation indications are received to the system in order to ensure that sufficient time has elapsed for the alarm device activation to have registered on the alarm panel and have been communicated through the data server, web server and remote wireless device. Other information regarding the alarm device can be input and associated with the alarm device, whether the alarm device passed or failed. For example, the inspector, tester, authorized user or the like can invoke the control 712 and take a picture to better illustrate any visual information associated with the device such as an improper mounting, damage or other anomaly. Such photographic information can be used by a responsible service company to provide, for example, proper parts for repair and possibly an estimation or quote for repair cost or the like. The inspector, tester, authorized user or the like can also invoke the control 717 to add notes or other information to further facilitate repair or provide additional information associated with an alarm device. If on the other hand, the activated alarm device is listed in the device list 822, an authentication screen as will be described in connection with FIG. 9 will be invoked.

Figure 9:
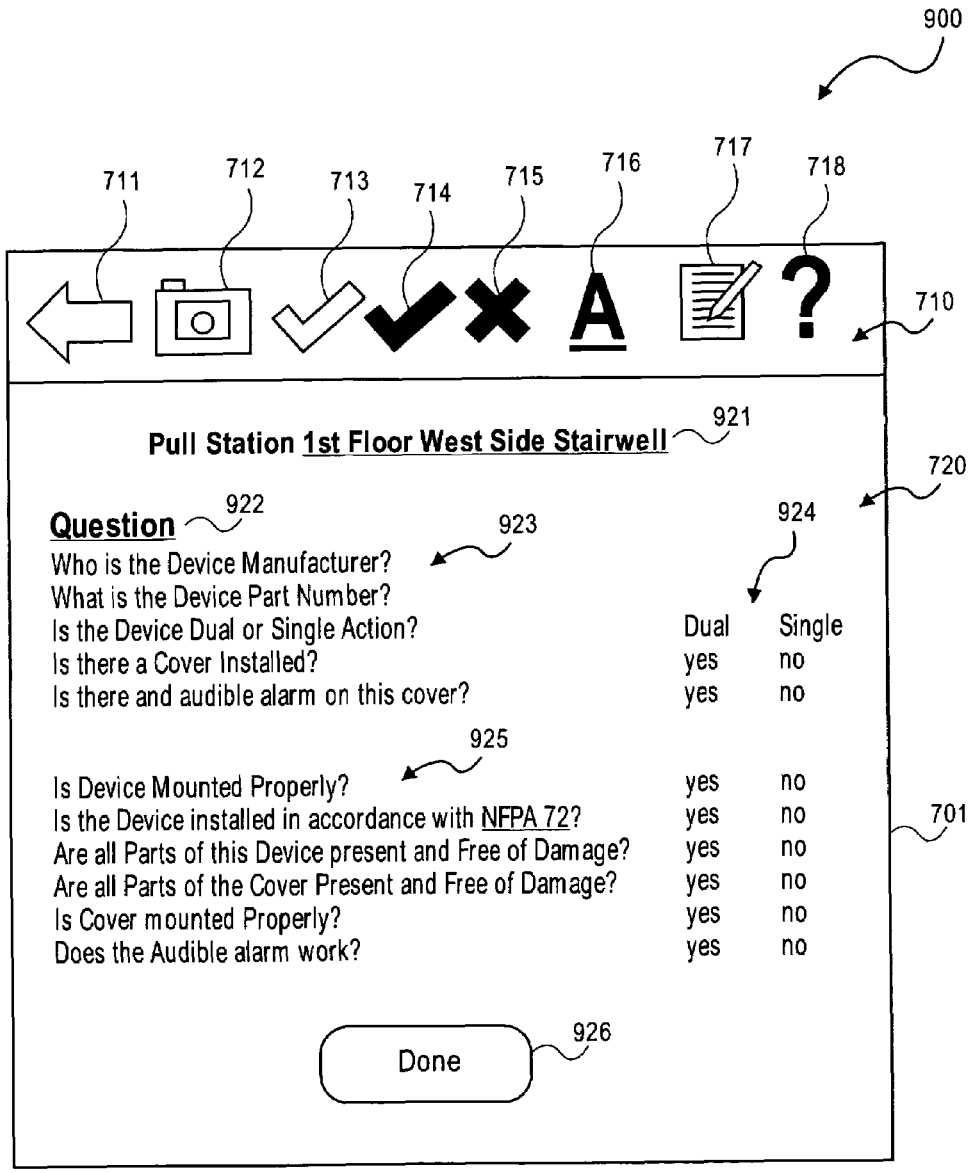
FIG. 9 is a diagram illustrating another screen of a user interface for further interacting with an authentication server in connection with testing a life safety system in a network environment including a remote accessory consistent with embodiments of the present invention.

As noted, the selection of the alarm device from device list 822 will invoke an authentication screen in connection with an exemplary scenario 900, as illustrated in FIG. 9. In the display pane portion 720 of screen 701 a message, label or screen title such as the identification information associated with the activated device can be displayed in information box 921 showing a list of device information questions 923 and possible pre-selected answers 924 under a Questions heading 922 and a list of device physical status questions 925 associated with the triggered alarm device. A tester, inspector, authorized user or the like can provide answers from pre-selected answers 924 or alternatively, answers can be input in a dialog or the like. When the questions under heading 922 are answered the answers can be loaded into the system, such as transferred to the data server and stored in the data store by activating the Done button 926. It will be appreciated that while many variants of the above described user interface are possible, one focus of the invention is the presentation of information screens that are stored externally on a data server and transferred to an inspector, tester, authorized user on a wireless device from, for example, a web server, wireless router, access point, wireless interface or the like. The inspector, tester, user or the like can likewise input information associated with a test in progress, which information will be transferred to the data server and used to update the status of the facility test.

Figure 10:
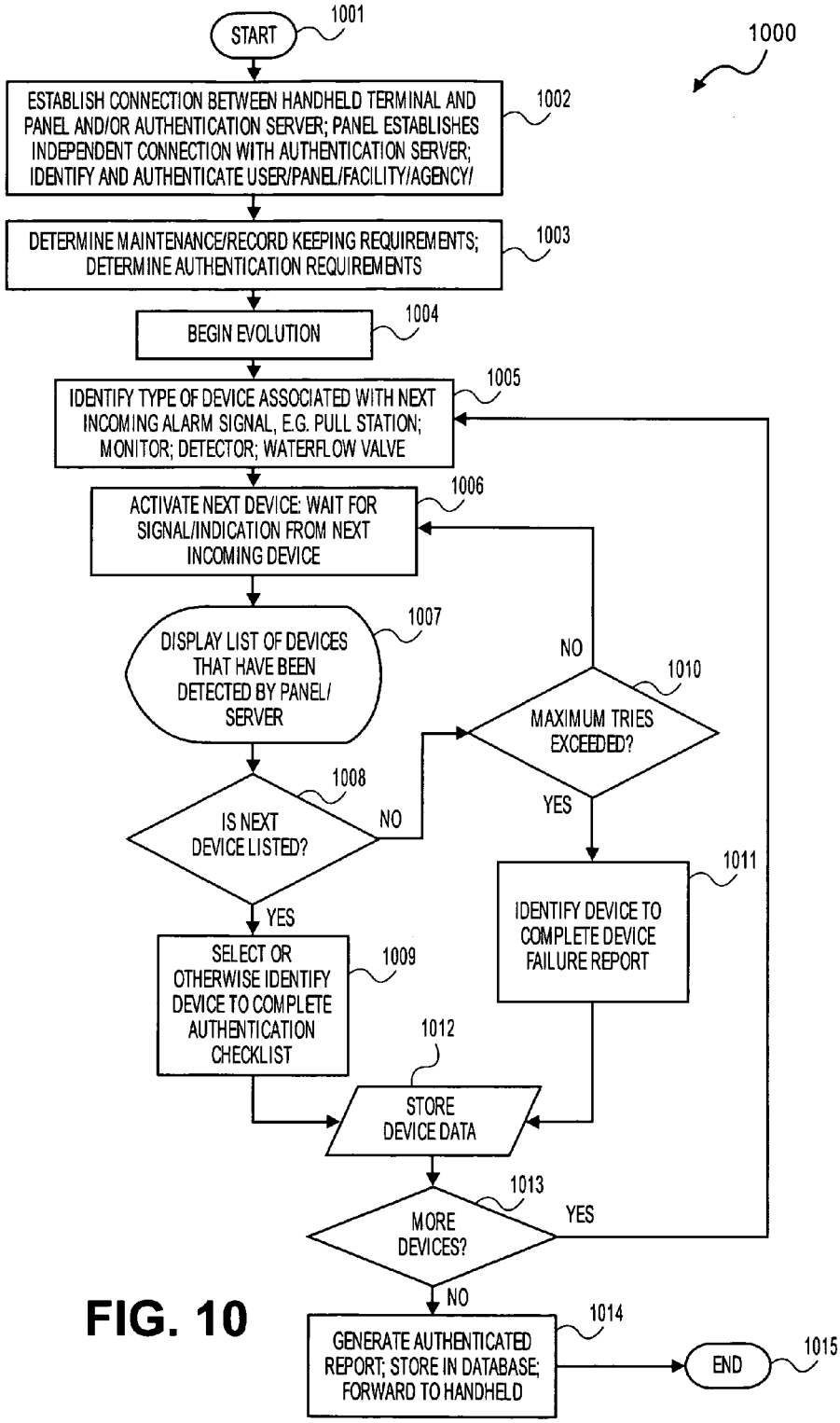
FIG. 10 is a flow chart illustrating an exemplary procedure for interacting with an authentication server in connection with testing a life safety system in a network environment including a remote accessory consistent with embodiments of the present invention.

To better appreciate exemplary operation in accordance with various embodiments of the present invention, a flow chart containing a procedure 1000 is shown in FIG. 10. In order to test an existing facility or setup a new facility to provide authenticated test, inspection, service or the like, a tester, operator, fire safety officer, inspector or the like (Inspector) first arrives on site, calling the exemplary system offline, and notifying building personnel. The Inspector identifies a printer terminal to be connected to the (RS-232) port present on the alarm control panel. The Inspector connects a serial cable via Transmit, Receive, Reference wires as identified in the control panel manufacturer's user manual, or in connection with the typical conventions established in the RS-232 standard. It will be appreciated that in some applications, a null modem cable may be necessary, such as will generate a hard connection between the Tx conductor of the interface to the Rx conductor of the reading device and vice versa. The Inspector connects db9 or other serial interface cable to laptop PC or other interface equipment for collecting, sorting, storing, and transmitting of data to a remote server, such as over a network or the Internet or the like. The Inspector then sets port settings for their computer, if necessary, as defined in the control panel manufacturer's manual for port settings, including Baud Rate, Stop bits, Flow Control, and Parity as required. The port settings may be included automatically in a later procedure such as when the panel is selected. The Inspector then connects the interface unit to a network such as the Internet. The Inspector opens an application program consistent with embodiments of the present invention, and can take steps associated with security such as logging in with their user name and password. The Inspector enters the building ID number assigned to their site, selects the building name, or the like to identify the building. The Inspector selects the type of inspection to be performed on a time basis such as Annual, Semi-Annual, Quarterly, or the like; or can specify by equipment such as Sprinkler, Fire Alarm, or the like.

After start at 1001, which can include the start up of the above described program and associated log-in, a connection can be established between a handheld device such as a remote wireless terminal or the like as described herein and an alarm control panel or to an authentication server at 1002. The alarm control panel establishes an independent connection with the authentication server. It will be appreciated that any handheld devices and panels can be authenticated as authorized users such as by providing a password and/or other identifying information that identifies the user, panel, facility, agency or the like as being authorized to use the authentication server. When a user of a handheld terminal and an alarm control panel associated with a facility are successfully authorized or otherwise authenticated, the authentication server can determine, such as by referring to a database, data store or the like, what the testing, maintenance or other record keeping requirements are for the facility as determined for example, by the fire code for the locality of the facility. If the facility is a new installation, or if a database has not been populated, then other methods of information entry such as by receiving information from the alarm panel can be used. For example, before an alarm panel begins a testing evolution, a software operation can be used to upload information into the authentication server. All of the individual devices associated with the facility along with the device information can be stored. During testing the stored information is compared to the generated by the alarm panel. Proper authentication results from a one-to-one correspondence between information associated with devices that are activated and stored device information associated with the facility.

Accordingly, whether verifying operation at a new installation or performing testing at an existing facility, an evolution can begin at 1004. During testing, a tester will identify the type associated with the next alarm device to be tested, for example, as described above in connection with FIG. 7, at 1005. The tester can activate the next alarm device at 1006 at which point the tester will wait for the indication from the next alarm device to arrive at the panel. Data generated by the panel can be collected as it is received and transmitted to, for example a data store associated with authentication server, data server or the like. The information is collected, sorted and stored based on the type of data received, the type of alarm device, the location of the building, and the like. It should be noted that the ability to monitor and store data generated by the alarm control panel has been previously disclosed, for example using the HyperTerminal facility as has been known and documented in the art since around 1999. Various hardware manufacturers provide the capability. However, the ability to read such information into an authentication server to provide authenticated feedback and authenticated test reports has not previously been disclosed in the art. After the indication arrives, a list of alarm devices will be displayed for example, as described above in connection with FIG. 8, at 1007. If the next alarm device, that is the alarm device that was registered and activated, is present in the list as determined for example at 1008, then the alarm device can be selected at 1009 or otherwise identified for completing an authentication checklist. Selection of the alarm device can invoke a question screen as described above, for example, in connection with FIG. 9. It will be appreciated that general questions on equipment not included in addressable device list, such as control equipment, power supply, batteries, wiring, and the like can be answered through separate screens such as note screens or the like. If the alarm device is not listed, then it can be determined if a maximum number of tries for the alarm device has been exceeded at 1010 including a maximum of 1. In other words it is possible that only one attempt can be made, or that additional retries are at the discretion of the tester. If more tries are desired and are possible for the alarm device, the activation of the alarm device at 1006 and procedures 1007 and 1008 can be repeated until the alarm device is seen or the maximum tries are exceeded. When the tries are exceeded, the alarm device can be identified in, for example, a Device Failure Report or the like at 1011. Once data from a tested alarm device is registered either as passed or failed, the information can be stored in a data store associated with the authentication server at 1012. If more alarm devices are present as determined at 1013, then the procedures 1005-1012 can be repeated as appropriate until no more alarm devices are to be tested. When no more alarm device are present, then an authenticated report can be generated, stored, for example, in a data store associated with the authentication server and forwarded to the handheld device at 1014. While the exemplary procedure is indicated as ending at 1015, it will be appreciated that the procedure can remain active, such as for addition testing evolutions or to perform other functions that may be included in a facility maintenance or management application, such as the automated certified maintenance of non-fire safety related equipment, or the like.

To better understand testing evolution and the generation of an authenticated report, it will be appreciated that in an exemplary testing or new building installation scenario, when an Inspector has logged in, a building ID number assigned to the site can be entered or alternatively, the building name can be selected. In the case of a new building, the Inspector can select an option to define a new building. In defining the new building, the Inspector defines the control panel or panels for use and number of loops on the system, and the like. The Inspector follows program prompts to collect information from the control panel by removing loops and placing devices into system or importing versions of the program for the system. The Inspector answers several basic setup questions to complete configuration of the authenticated report. The Inspector then disables the panel, ends the configuration program and begins initial inspection.

The following tables are excerpts from an exemplary report. It will be appreciated that the exact form of the report may vary from jurisdiction to jurisdiction without departing from the invention. In Table 1, for example, information about the control equipment, such as the control panel, annunciator panel and any auxiliary or other panels can be included in a report of test activity. The report can include the manufacturer, model number, location and the like.

TABLE 1

Control Equipment Report

| | | | | |
|---|---|---|---|---|
| Control Panel: | | | | 1 |
| Manufacturer: | Notifier | | | |
| Model: | AFP-200 | | | |
| Type: | Addressable | | | |
| SLC Circuits: | 1 | Stlyle: | 7 | |
| NAC Circuits: | 4 | Type: | B | |
| Location: | 1st Floor Main Entry | | | |
| Annunciation Panels: | | | | 1 |
| Manufacturer: | Notifier | | | |
| Model: | LCD-80 | | | |
| Type: | LCD w/ Controls | | | |
| Supervision: | Yes | Type: | 485 | |
| Location: | 1st Floor Rear Entry | | | |
| | | | | 2 |
| Manufacturer: | Notifier | | | |
| Model: | Colorgraphics | | | |
| Type: | Computer w/ Controls | | | |
| Supervision: | Yes | Type: | 485 | |
| Location: | 2nd Floor Maintenance Shop | | | |
| Booster/Auxiliary Panels: | | | | |
| Manufacturer: | Notifier | | | |
| Model: | BPS-24 | | | |
| Type: | Signal Expander | | | |
| Activation Type: | Addressable Output | | Address: L1M01 | |
| NAC Circuits: | 4 | | Type: B | |
| Location: | 1st Floor Electrical Closet - Behind FACP | | | |

As shown in Table 2, an initiating device report can further include information regarding the inspection status of various devices within the facility, such as alarm sensors, pull stations or the like, that are under test. It will be appreciated that the report can include several sections or the reports can be generated individually depending on particular requirements. The device portion of the report can include information about each device tested including, for example, a description of the device, the device zone, the time of test, the date of the test, the device address, the type of device, the inspection result, the test result, and the like.

TABLE 2

| Initiating Device Report<br>Control Panel: 1<br>SLC Loop: 1 | | | | | | | |
|---|---|---|---|---|---|---|---|
| Device Description | Zone | Test Time | Test Date | Device Address | Type | Inspected | Tested |
| $1^{ST}$ Floor Elevator Lobby | 01 | 08:14 | Nov. 01, 2006 | L1D01 | Smoke | Passed | Passed |
| $1^{ST}$ Floor Electrical Room | 01 | 08:21 | Nov. 01, 2006 | L1D02 | Smoke | Passed | Passed |
| $1^{ST}$ Floor Mechanical Room | 01 | 08:29 | Nov. 01, 2006 | L1D03 | Smoke | Passed | Passed |
| $2^{nd}$ Floor Elevator Lobby | 01 | 08:41 | Nov. 01, 2006 | L1D04 | Smoke | Passed | Passed |
| $2^{nd}$ Floor Electrical Room | 01 | 08:52 | Nov. 01, 2006 | L1D05 | Smoke | Failed | Passed |
| $2^{nd}$ Floor Mechanical Room | 01 | 09:33 | Nov. 01, 2006 | L1D06 | Smoke | Passed | Failed |
| $1^{st}$ Floor IT Room | 01 | 09:59 | Nov. 01, 2006 | L1D07 | Smoke | Passed | Passed |
| $1^{st}$ Floor Elevator Room | 01 | 10:09 | Nov. 01, 2006 | L1D08 | Smoke | Passed | Passed |
| $1^{st}$ Floor Front Entry | 01 | 09:59 | Nov. 01, 2006 | L1M02 | Pull Sta. | Passed | Passed |
| $1^{st}$ Floor Rear Entry | 01 | 10:11 | Nov. 01, 2006 | L1M03 | Pull Sta. | Passed | Passed |
| $2^{nd}$ Floor Front Entry | 01 | 10:22 | Nov. 01, 2006 | L1M02 | Pull Sta. | Passed | Passed |
| $2^{nd}$ Floor Rear Entry | 01 | 10:31 | Nov. 01, 2006 | L1M03 | Pull Sta. | Passed | Passed |

Still further, an output device report can be included as shown in Table 3. The output device report can include many of the same parameters as those of Table 2 such as the description, the zone, test date and time, address, type associated with the device and whether the device passed inspection and test.

TABLE 3

| Output Device Report | | | | | | | |
|---|---|---|---|---|---|---|---|
| Device Description | Zone | Test Time | Test Date | Device Address | Type | Inspected | Tested |
| Control Panel: 1<br>SLC Loop: 1 | | | | | | | |
| $1^{st}$ Floor West Circuit | 00 | 11:14 | Nov. 01, 2006 | P01 | NAC | Passed | Passed |
| $1^{st}$ Floor East Circuit | 00 | 11:16 | Nov. 01, 2006 | P02 | NAC | Passed | Passed |
| Spare | 00 | 11:19 | Nov. 01, 2006 | P03 | NAC | Passed | Passed |
| Spare | 00 | 11:21 | Nov. 01, 2006 | P04 | NAC | Passed | Passed |
| Booster Panel: 1 | | | | | | | |
| $2^{nd}$ Floor West Circuit | 00 | 11:23 | Nov. 01, 2006 | L1M01 | NAC | Passed | Passed |
| $2^{nd}$ Floor East Circuit | 00 | 11:26 | Nov. 01, 2006 | L1M01 | NAC | Passed | Passed |
| Spare | 00 | 11:29 | Nov. 01, 2006 | L1M01 | NAC | Passed | Passed |
| Spare | 00 | 11:35 | Nov. 01, 2006 | L1M01 | NAC | Passed | Passed |

Still further, a relay device report can be generated as shown in Table 4 including many of the same parameters as those of Tables 2 and 3 such as the description, the zone, test date and time, address, type associated with the device and whether the device passed inspection and test. It will also be appreciated that additional reports can be generated based on different classes of devices or the like that are present at the facility and that require authenticated testing.

TABLE 4

Relay Device Report
Control Panel: 1
SLC Loop: 1

| Device Description | Zone | Test Time | Test Date | Device Address | Type | Inspected | Tested |
|---|---|---|---|---|---|---|---|
| Elevator Recall Primary | 00 | 12:10 | Nov. 01, 2006 | L1M04 | Relay | Passed | n/a |
| Elevator Recall Primary | 00 | 12:12 | Nov. 01, 2006 | L1M05 | Relay | Passed | n/a |
| Door Release Relay | 00 | 12:15 | Nov. 01, 2006 | L1M06 | Relay | Passed | n/a |

Further in accordance with the present invention, the results of the inspection or test can be compiled and stored in a storage device as previously described and, since the results are obtained in an objective manner, authenticated for generation and/or publication of reports in a format that would be accepted by, for example, a local fire inspection jurisdiction. Such a report format is illustrated in the various pages of an exemplary authenticated report shown in FIGS. 11A, 11B, 11C and 11D. While the pages of the exemplary form are shown as blank in the figures, it will be appreciated that the information included in the form will vary from test to test based on the individual circumstances of the test such as the facility and individual test results. Information in Tables 1-4 described hereinabove, for example, can be envisioned as representative of the kind of information that would be included in the authenticated report as shown in the various pages of the exemplary authenticated report form. In FIG. 11A, page 1101 of the exemplary report form can include general information about the facility such as the name and address of the service organization, monitoring entity, name of the facility, approving agency or the like. As shown in Tables 1-4 herein, information regarding the testing of devices can be included in various sections such as the alarm initiating devices and circuits. In FIG. 11B, additional information is included in page 1102 of the exemplary form and can include detailed information regarding the alarm circuits and equipment such as the power supply types and battery types. In FIG. 11 C, additional information is included in page 1103 of the exemplary report form.

For conducting the inspection, the Inspector can connect to an Internet web site via a remote accessory such as a portable wireless device with the capability to provide Internet access and web browsing abilities. The device can be configured such that the server recognizes the login as being associated with the building by way of the building ID from an earlier step, which brings up the appropriate inspection forms. The Inspector tests all devices, verifies response on portable device, answers questions as required for that type of device, entering information where needed during the course of the inspection. It will be appreciated that one advantage of the present invention is the ability of the Inspector to conduct the inspection without traversing from a remote portion of the building back to the control panel or for another party to be located at the control panel to provide feedback. Even if feedback can be provided through, for example, a two-way radio or the like, the stationing of an additional person leads to inefficient use of manpower resources. Further, the present invention provides the advantage of generating an authenticated report associated with a test, the results of which are generated by an authentication server, which is generally off-site, but in any case is external to the alarm system and thus generates objective test results that form the basis of the authenticated report. Such reports can serve to satisfy regulatory requirements for compliance by local fire authorities and the like with a minimum of administrative efforts outside the test environment.

Upon completion of inspection, test or the like, where all questions of the system under test as required by the code are asked, the information is stored, for example, in a data store associated with the authentication server. The questions not applicable to the system type are segregated and eliminated at the server from being displayed or otherwise included in the report. Still further, device part numbers and other statistics are recorded and set. The Inspector can then disconnect from the alarm system and restore the system to normal operation. Inspection data is stored and saved on the authentication server or a remote server for record keeping compliance, archiving and for viewing at a later date.

It will be appreciated that the present invention allows authenticated inspection for addressable devices, and for non-addressable devices, authenticated inspection can still be provided, for example, by rapid loop clearing and remote reporting. In other words, if a condition is set for a non-addressable alarm on a particular loop having 5 non-addressable devices, the loop condition can be monitored and cleared remotely after each non-addressable device is activated such that the operation of each device can be authenticated within the system. The compliance of the non-addressable devices can be provided automatically, such as by sensing a loop alarm condition within a particular time frame after activating the device, or can be left to the discretion of the Inspector.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of conducting an authenticated test of an alarm system having components including an alarm control panel and alarm condition sensors, the alarm system requiring testing according to a fire code, the method comprising:

conducting a first access procedure to identify the alarm system and testing requirements associated with the alarm system, the first access procedure conducted to establish a first communication session between the alarm system and an authentication server during the authenticated test; and conducting a second access procedure to provide access for a remote device for facilitating the authenticated test, the second access procedure conducted to establish a second communication session between a remote monitoring and control device and one of the alarm system and the authentication server;

wherein:

(i) first information associated with an impending activation of one of the alarm condition sensors is received from the remote device;

(ii) second information associated with the one of the alarm condition sensors, when activated, is reported if detected by the alarm system, to the authentication server, the reported second information being forwarded to the remote device.

2. The method according to claim 1, wherein:

(iii) third information associated with one of: the activated and detected one of the alarm condition sensors; and the activated and undetected one of the alarm condition sensors is received from the remote device to provide authentication information associated with the one of the alarm condition sensors; and (iv) an authenticated report is forwarded to the remote device when all of the alarm condition sensors are tested according to the procedures in (i), (ii), and (iii).

3. The method according to claim 1, wherein:

(v) the information associated with the procedures in (i), (ii), and (iii) is stored in the authentication server.

4. A method of providing network-based authentication of a test of a fire alarm system having components including at least one control panel connected to a network and to a network-based server through the network, and fire alarm condition sensors connected to the at least one control panel, the fire alarm system requiring periodic certified testing, the method comprising:

storing identification information associated with the fire alarm system, the identification information including information associated with the at least one control panel and a number and one or more types of the fire alarm condition sensors and other information including activation status of the fire alarm condition sensors in an network-based server accessible by a subscriber; and providing the identification information and the other information including the activation status information to the subscriber.

5. The method according to claim 4, wherein the fire alarm condition sensors are manually activated by the subscriber during the periodic test and information associated with the manually activated fire alarm condition sensors is transferred to the network-based server.

6. The method according to claim 4, further comprising providing an authenticated report to the subscriber when the periodic test is complete.

7. The method according to claim 4, wherein the network includes the Internet.

8. The method according to claim 4, wherein the providing the identification information and the other information includes wirelessly providing the identification information and the other information.

9. A method for authenticating a test of a life safety system to ensure compliance thereof with a regulatory code, a control unit of the life safety system coupled to a server through a network, the method comprising:

establishing an interactive wireless connection between a remote wireless accessory and the server through the network, the interactive wireless connection associated with performing the test, the remote wireless accessory readable by an operator activating components of the life safety system;

inputting information about an impending activation of one of the components of the life safety system to the server through the remote wireless accessory;

outputting information about the activated one of the components of the life safety system from the server to the remote wireless accessory if the activation of the one of the components is independently detected by the control unit and transferred to the server, the independent detection by the control unit determining one of: authenticated compliance and authenticated non-compliance of the one of the components with a corresponding section of the regulatory code; and generating an authenticated report associated with the test when all of the components of the life safety system are determined to be one of compliant and non-compliant.

10. The method according to claim 9, further comprising storing the one of the authenticated compliance and the authenticated non-compliance of the one of the components with a corresponding section of the regulatory code.

11. The method according to claim 10, wherein the stored one of the authenticated compliance and the authenticated non-compliance of the one of the components cannot be modified.

12. The method according to claim 9, wherein the establishing the interactive wireless connection includes requesting a password from the operator.

13. The method according to claim 9, wherein the outputted information about the activated one of the components of the life safety system from the server to the remote wireless accessory is prevented from being modified.

14. The method according to claim 9, wherein the interactive wireless connection is established according to a transmission control protocol/ internet protocol (TCP/IP).

15. A remote device for wirelessly interacting with a fire alarm system, including fire alarm condition sensors, during a test of the fire alarm system, the remote device comprising:

a wireless network interface; an information display; and a controller coupled to the wireless network interface and the information display, the controller configured to:

establish a connection over the wireless network interface with one or more of a component of the fire alarm system and an authentication server; and exchange information over the established connection corresponding to ones of the fire alarm condition sensors, the information including one or more of information corresponding to ones of the fire alarm condition sensors: on which activation is impending; that are registering as active with the fire alarm system during activation; and that require additional information to be input to comply with a regulatory code.

16. The remote device according to claim 15, wherein the controller is further configured to receive and display an authenticated report associated with the test after the test is completed.

17. The remote device according to claim 15, wherein the remote device includes one of a laptop; a portable digital assistant (PDA); a cell phone; and a two-way radio.

18. An authentication server for coupling to a fire alarm system through a network, including fire alarm condition sensors, during a test of the fire alarm system, the authentication server comprising:

a network interface; and a controller coupled to the network interface configured to:

establish a first connection over the network interface with a remote accessory and second connection over the network interface with the fire alarm system;

receive information over the established first connection corresponding to an impending activation of one of the fire alarm condition sensors during the performance of the test;

receive information over the established second connection corresponding to ones of the fire alarm condition sensors registering as active with the fire alarm system during the test;

transmit information over the established first connection corresponding to the ones of the fire alarm condition sensors registering as active with the fire alarm system during the test;

receive authentication information over the established first connection, the authentication information corresponding to the activation of the one of the fire alarm condition sensors that was impending; and transmit an authenticated report over the established first connection, the authenticated report including the authentication information associated with all of the fire alarm condition sensors at the completion of the test.

19. The authentication server according to claim 18, further comprising a storage device, and wherein the controller is further configured to store the information associated with the test.

20. The authentication server according to claim 19, wherein the information includes one or more of: an activation time of the one of the fire alarm condition sensors, an activation date of the one of fire alarm condition sensors, an event type, a condition type, a device address of the one of the fire alarm condition sensors.

* * * * *